US009061427B2

(12) United States Patent
Rubin et al.

(10) Patent No.: US 9,061,427 B2
(45) Date of Patent: Jun. 23, 2015

(54) MULTI-TOOL WITH ARTIFICIAL KEY AND LED

(75) Inventors: Bennett S. Rubin, Pepper Pike, OH (US); Richard C. Adamany, Chagrin Falls, OH (US)

(73) Assignee: INTERDESIGN, INC., Solon, OH (US)

( * ) Notice: Subject to any disclaimer, the term of this patent is extended or adjusted under 35 U.S.C. 154(b) by 0 days.

(21) Appl. No.: 14/239,182

(22) PCT Filed: Aug. 25, 2011

(86) PCT No.: PCT/US2011/001496

§ 371 (c)(1), (2), (4) Date: Feb. 17, 2014

(87) PCT Pub. No.: WO2013/028147

PCT Pub. Date: Feb. 28, 2013

(65) Prior Publication Data

US 2014/0192519 A1 Jul. 10, 2014

(51) Int. Cl.

| | |
|---|---|
| ***F21V 33/00*** | (2006.01) |
| ***B26B 11/00*** | (2006.01) |
| ***A44B 15/00*** | (2006.01) |
| *E05B 17/10* | (2006.01) |

(52) U.S. Cl.

CPC ..... *B26B 11/008* (2013.01); *E05B 17/103* (2013.01); *B26B 11/00* (2013.01); *A44B 15/00* (2013.01)

(58) Field of Classification Search

CPC ..... B26B 11/00; B26B 11/008; B25B 7/22; A44B 15/00; A44B 15/005; A45C 11/321; E05B 17/10; E05B 17/103; F21V 23/0414; F21V 21/0885; F21V 33/0084

USPC ..... 362/116, 119, 120

See application file for complete search history.

(56) References Cited

U.S. PATENT DOCUMENTS

| | | | |
|---|---|---|---|
| D3,942 | S | 3/1870 | Elwell |
| 172,195 | A | 1/1876 | Spring |
| 200,512 | A | 2/1878 | Coleman |
| 384,592 | A | 6/1888 | Ross |
| 1,561,262 | A | 11/1925 | Martin |
| 2,371,308 | A | 3/1945 | Mosch |
| 2,412,056 | A | 12/1946 | Mosch |
| 2,558,265 | A | 6/1951 | Mosch |
| 3,310,668 | A | 3/1967 | Schwartz |
| 3,453,729 | A | 7/1969 | Larson |
| 4,324,121 | A | 4/1982 | Richter |
| 4,376,383 | A | 3/1983 | Wolter |
| 5,077,850 | A | 1/1992 | Brubaker |
| 5,279,021 | A | 1/1994 | Edgin |
| 5,491,856 | A | 2/1996 | Legg |
| 5,621,936 | A | 4/1997 | Penaligon et al. |
| 5,809,600 | A | 9/1998 | Cachot |
| D405,953 | S | 2/1999 | Legg |
| 5,887,306 | A | 3/1999 | Huang |
| 5,966,972 | A | 10/1999 | Chuang |
| 5,996,451 | A | 12/1999 | Seber et al. |
| 6,006,562 | A | 12/1999 | Wolter |

(Continued)

*Primary Examiner* — Y M Lee

(74) *Attorney, Agent, or Firm* — D. Peter Hochberg; Sean F. Mellino

(57) ABSTRACT

A faux key tool and light device has a head assembly and a faux key blade assembly. The head assembly has a head housing with a battery compartment, a lens opening and an actuating button opening. The faux key blade assembly has a pair of flat, opposing spaced walls having opposing edges with faux key teeth, and a knife blade pivotally mounted between the spaced walls.

9 Claims, 5 Drawing Sheets

(56) References Cited

U.S. PATENT DOCUMENTS

| | | | |
|---|---|---|---|
| 6,109,147 | A | 8/2000 | Legg |
| 6,112,352 | A | 9/2000 | Legg |
| D442,466 | S | 5/2001 | Van Den Acker |
| 6,223,372 | B1 | 5/2001 | Barber |
| 6,286,397 | B1 | 9/2001 | Taggart et al. |
| 6,332,345 | B1 | 12/2001 | Huang |
| 6,347,875 | B1 | 2/2002 | Painsith |
| 6,418,628 | B1 | 7/2002 | Steingass |
| 6,460,698 | B1 | 10/2002 | Wang |
| 6,487,941 | B1 | 12/2002 | Ping |
| 6,564,678 | B1 | 5/2003 | Wang |
| 6,574,817 | B2 | 6/2003 | Wu |
| D514,063 | S | 1/2006 | Rubin et al. |
| 7,008,076 | B2 | 3/2006 | Zirk et al. |
| 7,036,950 | B1 | 5/2006 | Freeman et al. |
| D522,519 | S | 6/2006 | Rubin et al. |
| D525,247 | S | 7/2006 | Rubin et al. |
| 7,140,280 | B2 | 11/2006 | Hawkins et al. |
| 7,146,667 | B2 | 12/2006 | Elsener |
| 7,159,993 | B1 | 1/2007 | Lu |
| D543,297 | S | 5/2007 | Osiecki et al. |
| D544,388 | S | 6/2007 | Chisholm |
| D549,542 | S | 8/2007 | Chiang |
| D551,802 | S | 9/2007 | Rubin et al. |
| D552,276 | S | 10/2007 | Shaljian |
| D555,455 | S | 11/2007 | Cheng |
| 7,306,366 | B1 | 12/2007 | Camenzind et al. |
| 7,325,312 | B1 | 2/2008 | Janich |
| 7,329,021 | B1 | 2/2008 | Hoffman |
| D564,387 | S | 3/2008 | Rubin et al. |
| D575,182 | S | 8/2008 | Rubin et al. |
| D593,693 | S | 6/2009 | Adamany et al. |
| D595,106 | S | 6/2009 | Rubin et al. |
| 7,557,720 | B2 | 7/2009 | Rubin et al. |
| D598,266 | S | 8/2009 | Rubin et al. |
| D622,955 | S | 9/2010 | Mudrick et al. |
| 7,810,415 | B2 | 10/2010 | Adamany et al. |
| 2001/0034910 | A1 | 11/2001 | Taggart et al. |
| 2003/0137833 | A1 | 7/2003 | Hsu |
| 2006/0075570 | A1 | 4/2006 | Gelfand |
| 2006/0164826 | A1 | 7/2006 | Ackermann et al. |
| 2006/0215394 | A1 | 9/2006 | Evans |
| 2007/0159811 | A1 | 7/2007 | Chen |
| 2007/0182572 | A1 | 8/2007 | Rubin et al. |
| 2009/0296377 | A1 | 12/2009 | Berman |
| 2010/0319138 | A1 | 12/2010 | Adamany et al. |

MULTI-TOOL WITH ARTIFICIAL KEY AND LED

BACKGROUND OF THE INVENTION

1. Field of the Invention

This invention relates to miniature tool kits with an illumination device, and in particular to a faux key device incorporating a hidden but accessible knife blade with a manually operable illuminating device 2. Description of the Prior Art Miniature tool kits are well known in the art. Various devices are known which can be stored in a pant's pocket or a handbag and whose utilitarian devices remain secured until they are needed and can be manually accessed for operation.

There are many descriptions of miniature tool kits which can be held in a person's pocket or in a handbag. These include U.S. Pat. No. 6,347,875 (Painsith 2002, including among other things a pen knife), U.S. Pat. No. 5,809,600 (Cachot 1998, also having a pen knife), U.S. Pat. No. 5,887,306 (Huang 1999, screwdriver and knife), U.S. Pat. No. 5,996,451 (Seber et al., hand tool including pliers), U.S. Pat. No. 6,286,397 (Taggart et al. 2001, tool kit for use with sports equipment), U.S. Pat. No. 6,564,678 (Wang 2003. a plurality of tool kits), U.S. Pat. No. 6,574,817 (Wu 2003, a complex tool kit having two tool assemblies), U.S. Pat. No. 7,140,280 (Hawkins et al., tool kit with pivotable tools), U.S. Pat. No. 7,810,415 (Adamany et al., foldable tool kit with expandable tools), U.S. Pat. No. 5,491,856 (Legg 1996, a foldable multiple-function tool), U.S. D555,455 S (Cheng 2007, multi-function tool), D549,542 S (Chiang 2007, tool kit), D598,266 S (Rubin et al. 2009, portable tool set), D595,106 S (Rubin et al. 2009, portable tool set), U.S. Pub. 2010/0319138 A 1 (Adamany et al., a miniature tool kit with an auto-release clasp and expandable tools), U.S. Pat. No. 7,810,415 (Adamany et al. 2010, miniature tool kit with an auto-release clasp and expandable tools), D522,519 S (Rubin et al. 2006, miniature tool kit), D551,802 S (Rubin et al. 2007, miniature tool kit), U.S. Pat. No. 6,112,352 (Legg 2000, foldable tool kit) and U.S. Pat. No. 6,109,147 (Legg 2000, hexagonal tool bit set).

A number of these miniature tool kits have illuminating devices such as flashlights, flashers and LEDs. This group includes U.S. 2007/0182572 A1 (Rubin et al. 2007, emergency device with a flashlight and emergency flasher), US 2006/0075570 A1 (Gelfand 2006, a handheld multi-functional knife assembly with a compartment for holding foldable tools), U.S. Pat. No. 7,306,366 (Camenzind et al. 2007, a folding knife with a flashlight that can be powered by a battery or a solar cell), U.S. Pat. No. 7,008,076 (Zirk et al. 2006, a folding knife with a light that can be powered by conventional batteries, a solar-powered series of cells or a solar-charged battery), U.S. Pat. No. 7,810,415 (Adamany et al. 2010, a portable tool kit having electrically powered lamps), US 2006/0164826 A1 (Ackermann et al. 2006, a pocket lamp having a rechargeable energy-storage unit), and U.S. Pat. No. 6,460,698 (Wang 2002, a planer tool casing that can be held in a pocket and having one or more lights). There are also U.S. design patents that can be stored in a pocket and have an illumination device including D593,693 S (Adamany et al. 2009, a combined flashlight and docking station), D564,387 S (Rubin et al. 2008, a handheld emergency tool), D552,276 S (Shaljian 2007, a cellular phone light), D544,388 S (Chisholm 2007, an emergency light), D543,297 S (Osiecki et al. 2007, a lighting device), D525,247 S (Rubin et al. 2006, a micro-pro flash drive), D522,519 S (Rubin et al. 2006, a micro-pro flash drive), D514,063 S (Rubin et al. 2006, a micro-flashlight docking station).

There are also known in the prior art many key ring devices having different key ring assemblies and other apparatuses combined with the key rings. These include US 2003/0137833 Al (Hsu 2003, a mini-flashlight incorporated on a key ring), U.S. Pat. No. 7,810,415 (Adamany et al., an expandable tool kit on a key ring), U.S. Pat. No. 7,146,667 (Elsener 2006, a pocket tool including knife blades incorporated on a key ring), U.S. Pat. No. 6,332,345 (Huang 2001, a key ring structure having a disc for holding a number of key rings), U.S. Pat. No. 6,006,562 (Wolter 1999, a collective holder having a number of slidable runners each of which include a key ring), U.S. Pat. No. 6,487,941 (Ping 2002, a foldable hand tool for being mounted on a key ring), U.S. Pat. No. 6,460,698 (Wang 2002, a planer tool casing mounted on a keychain, U.S. Pat. No. 6,418,628 (Steingass 2002, a car window breaker mounted on a keychain loop), U.S. Pat. No. 5,491,856 (Legg)996, a foldable multiple-function tool which can be mounted on a key ring), U.S. Pat. No. 5,279,021 (Edgin 1994, an article retaining apparatus for being mounted on a key ring), U.S. Pat. No. 5,077,850 (Brubaker 1992, a utility device for a key ring), U.S. Pat. No. 4,324,121 (Richter 1982, a ring having a removable metal ring for the insertion and removal of keys where the ring is rotatable in a handle portion), U.S. Pat. No. 2,558,265 (Mosch 1951, a pocket utensil holder having pivotally-mounted keys), 2,412,056 (Mosch 1946, a utensil holder having pivotally-mounted keys), U.S. Pat. No. 2,371,308 (Mosch 1945, a pocket utensil holder having pivotally mounted keys), U.S. Pat. No. 1,561,262 (Martin 1925, a pocket implement mounted on a key ring), US 2010/0319138 A1 (Adamany et al. 2010, a portable tool kit mounted on a clasp), U.S. Pat. No. 7,557,720 (Rubin et al. 2009, a personal emergency device mounted on a key ring), U.S. Pat. No. 5,491,856 (Legg 1996, a foldable multi-function tool mountable on a key ring). There are also a number of U.S. design patents disclosing various devices mountable on a key ring or incorporating a key ring, including D593,693 S (Adamany et al. 2009, a combined flashlight and docking station), D575,182 S (Rubin et al. 2008, a handheld emergency tool mountable on a key ring), D522,519 S (Rubin et al. 2006, a micro-pro flash drive mountable on a key ring), D543,297 S (Osiecki et al. 2007, a lighting device incorporating a key ring) and D622,955 S (Mudrick et al. 2010, a solar-powered key ring).

Significant patents issued on a device known as a Utili-Keye key ring tool, namely U.S. Pat. Nos. 6,112,352 and D405,953 issued to Larry K. Legg on Sep. 5, 2000. The latter device incorporated an artificial key, having a pivot point in a pair of opposed head portions of two integral parts that were pivotally mounted to the pivot point. One integral portion had a head portion with an extending flat screwdriver head on one side of the pivot and an elongated portion with a serrated knife blade and an adjacent straight knife blade. The latter blades were only exposed when the second part of the key ring tool was pivoted to an open position about the pivot point. The other portion had a Phillips screwdriver defining a free end of the second integral portion to which was mounted a bottle opener. Also on the second portion was a micro eyeglass screwdriver. The latter device was similar to that of the present invention, at least as to the extent that they both incorporated an artificial or faux key, but the respective constructions are quite different.

SUMMARY OF THE INVENTION

An object of the present invention is to provide a tool and illuminating device which is compact, rugged and easy to use in operation.

Another object of the present invention is to provide a compact tool and illuminating device which can be held on a key ring, the device having a closed condition to protect its surroundings and the device, and an open condition for use.

Still another object of the present invention is to provide a faux key tool and illuminating device which can be held on a key ring and give the appearance of being a key, yet functioning as a cutting tool and as a source of illumination.

It is yet an additional object of the present invention to provide a faux key tool and illuminating device having an easily accessible actuating button for the light source and an easily accessible battery compartment for providing batteries to a circuit board to which the illumination device is connected.

It is yet still another object of the present invention to provide a faux key tool and illuminating device where the tool is a knife blade which can be pivoted to extend the length of the knife blade to provide better torque for its operation and render it easier to use in many applications.

It is still an additional object of the present invention to provide a faux key tool and illuminating device having an appropriate covering on the head of the faux key to both make the faux key easier to handle and to provide it with greater similarity to modem keys.

Another object of the present invention is to provide a faux key tool and illuminating device where the like device is an LED which provides illumination from an easy-to-aim position at an end edge of the faux key.

Another object of the present invention is to provide a faux key tool and illuminating device having a quick-disconnect key ring assembly.

A general object of the present invention is to provide a faux key tool and illuminating device which is inexpensive to manufacture, rugged in construction and easy to use.

Other objects will be apparent from the description to follow and from the appended claims.

The foregoing objects are achieved according to the preferred embodiment of the invention by a faux key tool and light or illuminating device which comprises a key head assembly. and a faux key blade assembly. The key head assembly includes a key head housing having a battery compartment and a lens opening for a lens and an actuating button opening for rendering an actuating button accessible. The faux key blade assembly includes a faux key blade housing having a pair of opposing, generally flat elongated walls extending from the key head housing in a side-by-side or opposing relationship and defining a space between them. A knife blade is pivotally mounted for movement between the elongated walls between an open position in which the cutting edge portion is exposed and a closed position in which the cutting edge portion is unexposed. An actuating button is accessible on one of opposing faces of the head housing, and a battery compartment having a cover is on the other face of the head housing. The knife blade is preferably pivotally mounted at the free end of the elongated walls. An illumination device in the form of an LED is disposed in an LED-with-lens compartment at an end of the key head housing which is opposite from the elongated walls. A circuit board electrically connectable to the LED is located in a compartment. Each of the described compartments are located in the key head assembly and are longitudinally spaced and separated from the elongated walls and the knife blade when the latter is in its closed position to assist in making the key head assembly thin to make the device look more like a motor vehicle key. The key head is preferably covered with a polycarbonate/acrylonitrile butadiene styrene which is a moldable plastic that is hard, does not undergo chemical change when heated, and is used on many keys, such as those used with automobiles and other motor vehicles.

DESCRIPTION OF THE PREFERRED EMBODIMENT

Figure 6:
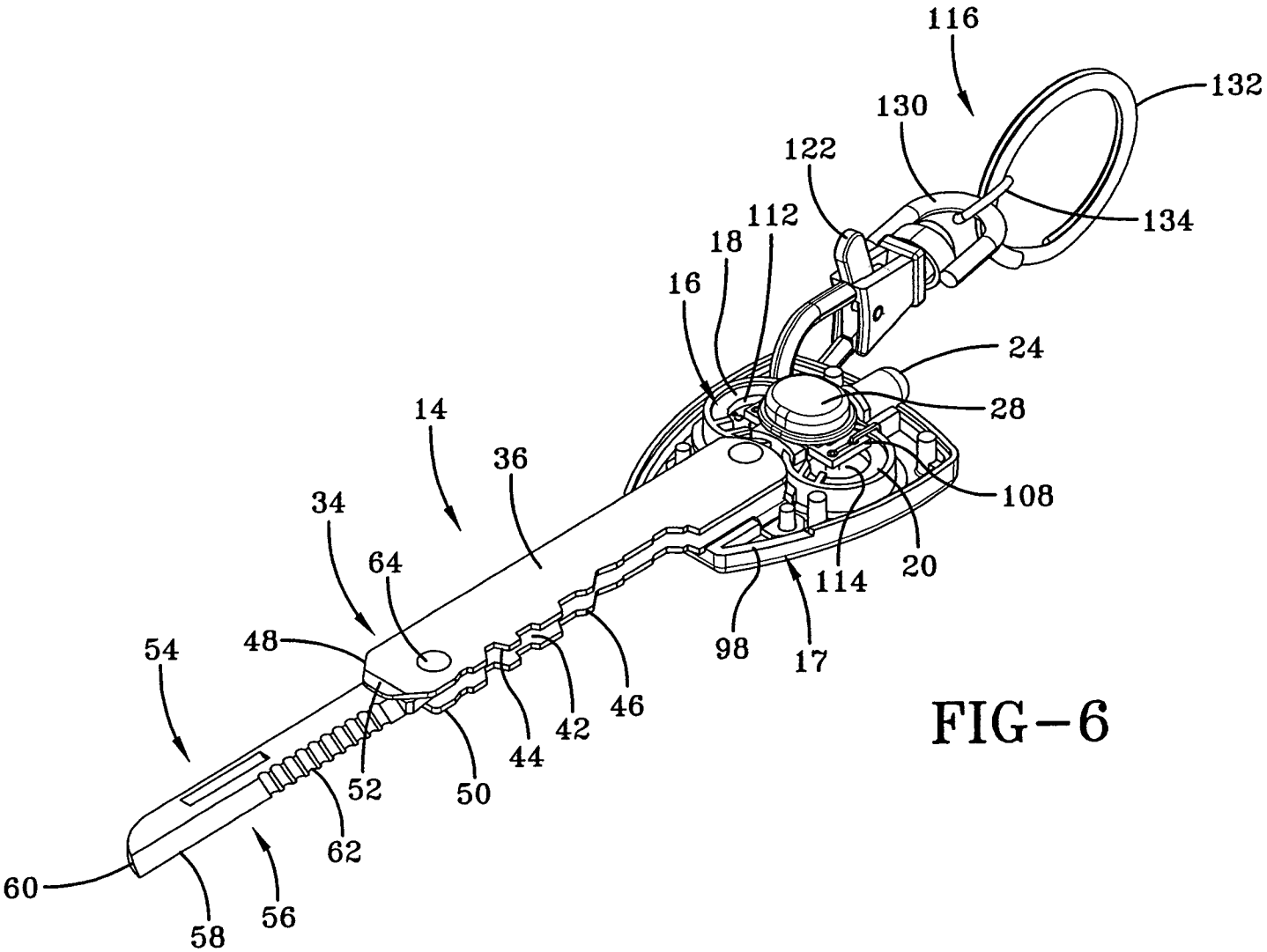
FIG. 6 is a perspective view of the device shown in FIG. 4 with part of the head housing removed.
Figure 7:
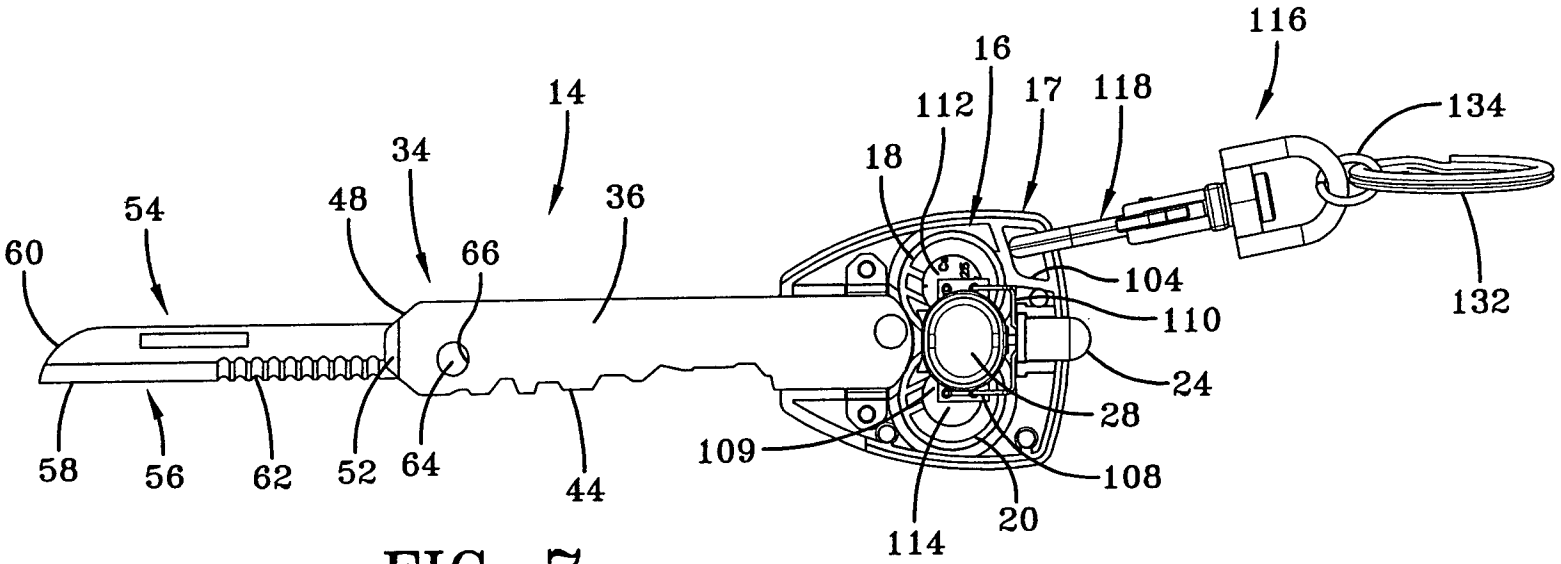
FIG. 7 is atop view of the device shown in FIG. 6.
Figure 8:
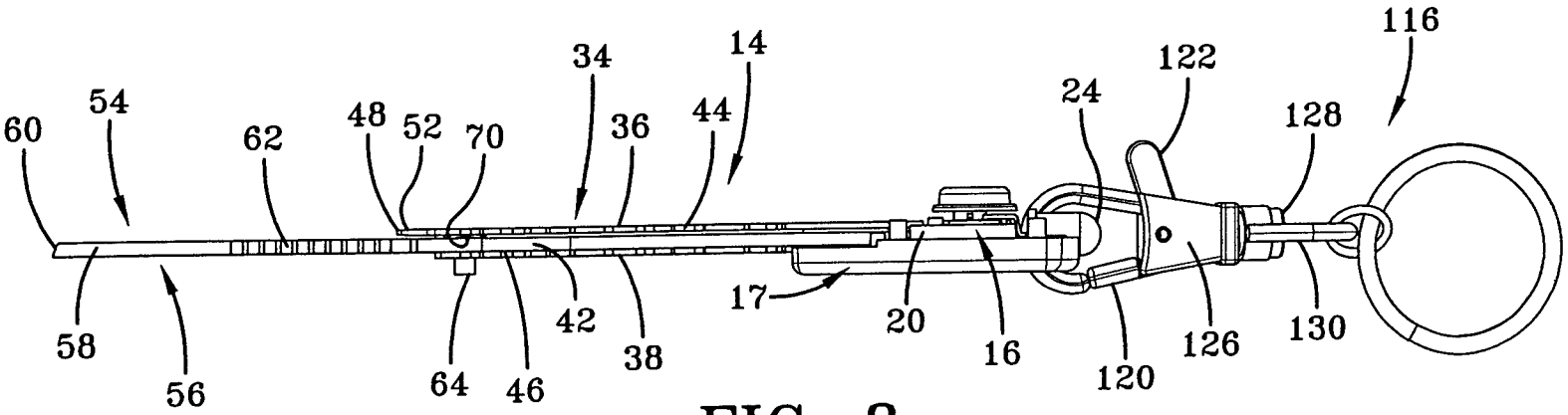
FIG. 8 is a side view of the device shown in FIG. 7.

Referring to FIGS. 1-5, a faux key tool and illuminating device 10 according to the preferred embodiment of the invention is shown. Device 10 includes a key head assembly 12 and a faux key blade assembly 14 extending in a longitudinal direction as shown in each of the drawings. Key head assembly 12 has a key head housing 13 with an exterior and an interior, a battery compartment 16 in the interior as shown in FIGS. 6-8, which is shown as having two single battery compartments 18 and 20 for holding batteries in a snug relationship, a lens opening 22 through which an LED with lens 24 extends, and an actuating button opening 26 through which an actuating button 28 is accessible. Key head housing has a lateral direction transverse to the longitudinal direction. Battery compartment 16 has a selectively removable battery compartment cover 30 which can be removed by a closing device such as a Phillips head screw 32 as described below. Key head housing 13 has a front key head housing 15 and a rear key head housing 17, each having flat exterior surfaces. Battery compartments are configured to hold cell batteries with the flat surfaces of the batteries being parallel with the other exterior surfaces of the flat walls of housings 15 and 17. Faux key blade assembly 14 includes a faux key blade housing 34 with a forward, generally flat elongated wall 36 and a rear, generally flat elongated wall 38, and a knife blade 54 having a cutting edge portion 56. The lateral dimension of elongated walls 36 and 38 is substantially less than the lateral dimension of key head housing 13 to render device 10 to have a closer key-like appearance as well as to render device 10 more compact and easier to store in a person's pocket or purse such as on a key chain. Actuating button opening 26 is longitudinally spaced and separated from knife blade 54 when the latter is in its closed position, and close to the circuitry for operating LED-with-bulb 24 as discussed below. Walls 36 and 38 are connected at one edge by an edge wall 40 which can be integral with rear, generally flat elongated wall 38 from which it can advantageously having been bent during the manufacturing process. Walls 36 and 38 are separated from each other by a blade-receiving space 42 shown in FIGS. 3, 5, 6 and 8. Walls 36 and 38 have respective opposing edges 44 and 46, respective free ends 48 and 50 and distal head assembly 12 as shown in the drawings. Free end 48 has a flat screwdriver head 52 thereon for enabling device 10 to act as a screwdriver.

Cutting edge portion 56 includes a straight knife blade 58 extending from a free end 60 of knife blade 54, and a serrated knife blade 62 extending from straight knife blade 58 towards the inner part of knife blade 54.

A pivot pin 64 extends through a hole 66 in front, generally flat elongated wall 36, a hole 68 in rear, generally flat elongated wall 38 and a hole 70 extending through knife blade 54. The pivot point at pivot pin 64 enables a greater torque to be applied to knife blade 54 because of the added length of elongated walls 36 and 38. It can be seen in FIG. 2 that pivot pin 64 extends through a somewhat enlarged hole 68 in elongated wall 38 and that pin 64 must be compressed or flattened to fill hole 68 and prevent the disengagement of pin 64 from walls 36 and 38.

Free edges 44 and 46 of elongated walls 36 and 38 have opposing faux key teeth 72 and 74, respectively, for rendering elongated walls 36 and 38 to appear to be a key blade with millings or grooves forming the teeth.

As mentioned previously, key head assembly 12 includes a front key head housing 15 and a rear key head housing 17. Front key head housing 17 includes centrally disposed actuating button opening 26 through which actuating button 28 extends, rendering it easy to use. Rear key head housing 17 includes removable battery compartment cover 30 (FIG. 2) which is easily removable for changing the batteries by means of loosening screw 32. Screw 32 can be tightened into a receptacle located in removable battery compartment cover 30, but screw 32 cannot be removed from battery compartment cover 30 since it is locked in place in a small metal liner on the interior side of battery compartment cover 30. This prevents screw 32 from become separated from cover 32 and being lost. The metal liner also completes an electrical circuit through the batteries in battery compartment 16.

Front key head housing 15 has a pair of convexly curved, opposing sides 76 and 78. Front key head housing 15 also has a key blade end side 80 interconnecting curved sides 76 and 78 proximal blade assembly 14, and a free end side or light-emitting side 82 opposing key blade side 80. Likewise, rear key head housing 17 includes a convexly curved side 84 and an opposing convexly curved side 86. Sides 84 and 86 are opposed to and are so configured that curved sides 76 and 78 of front key head housing 15 match curved sides 84 and 86 of rear key head housing 17. Likewise, rear key head housing 17 has a key blade side 88 and a free end side 90 which oppose and match corresponding key blade side 80 and free end side 82 of front key head housing 15. Lens opening 22 is formed of two essentially semicircular openings in each of free end sides 82 and 90 of front key head housing 15 and rear key head housing 17.

Figure 1:
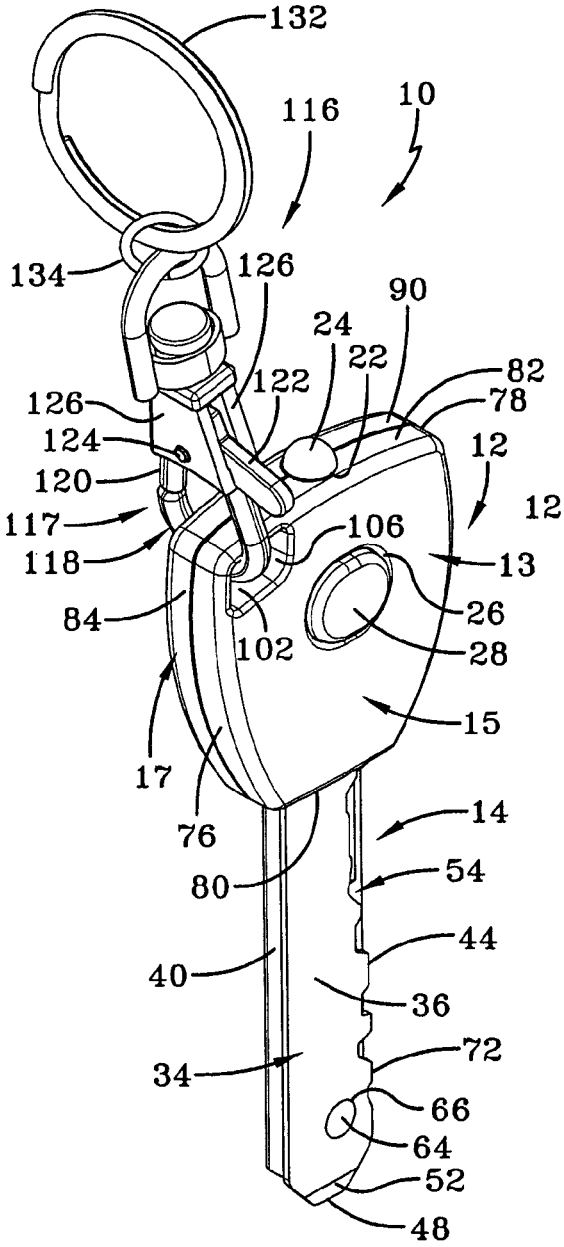
FIG. 1 is a perspective view of the faux key tool and illuminating device according to a preferred embodiment of the invention with a knife blade in the closed position.
Figure 2:
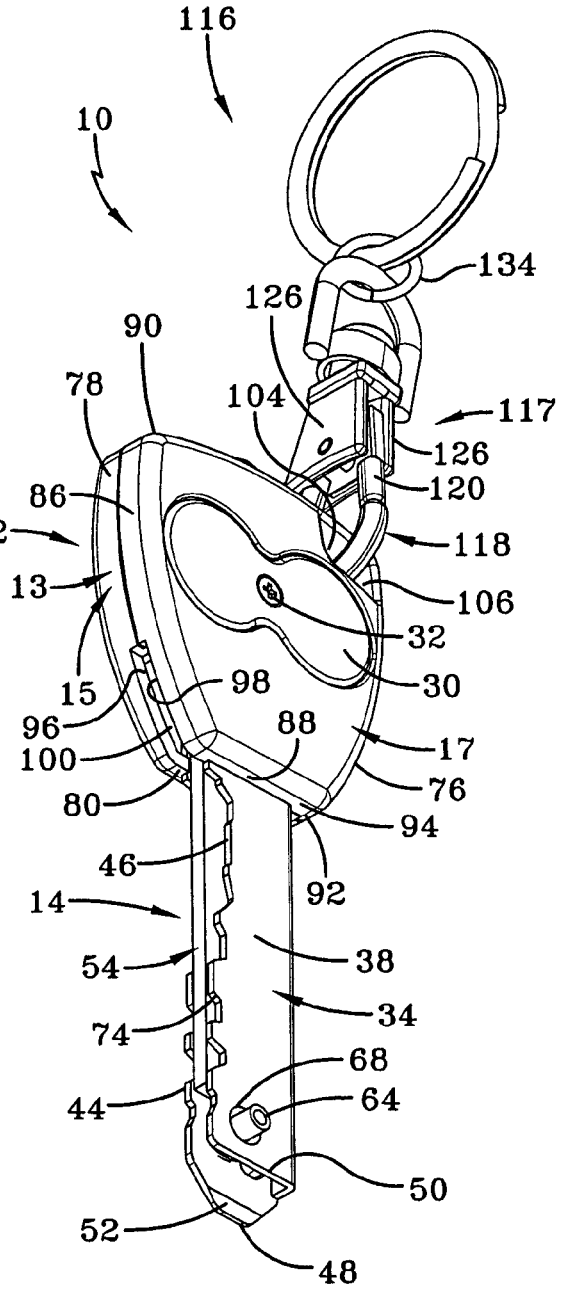
FIG. 2 is a perspective view of the device shown in FIG. 1 taken from the other side of the device.
Figure 3:
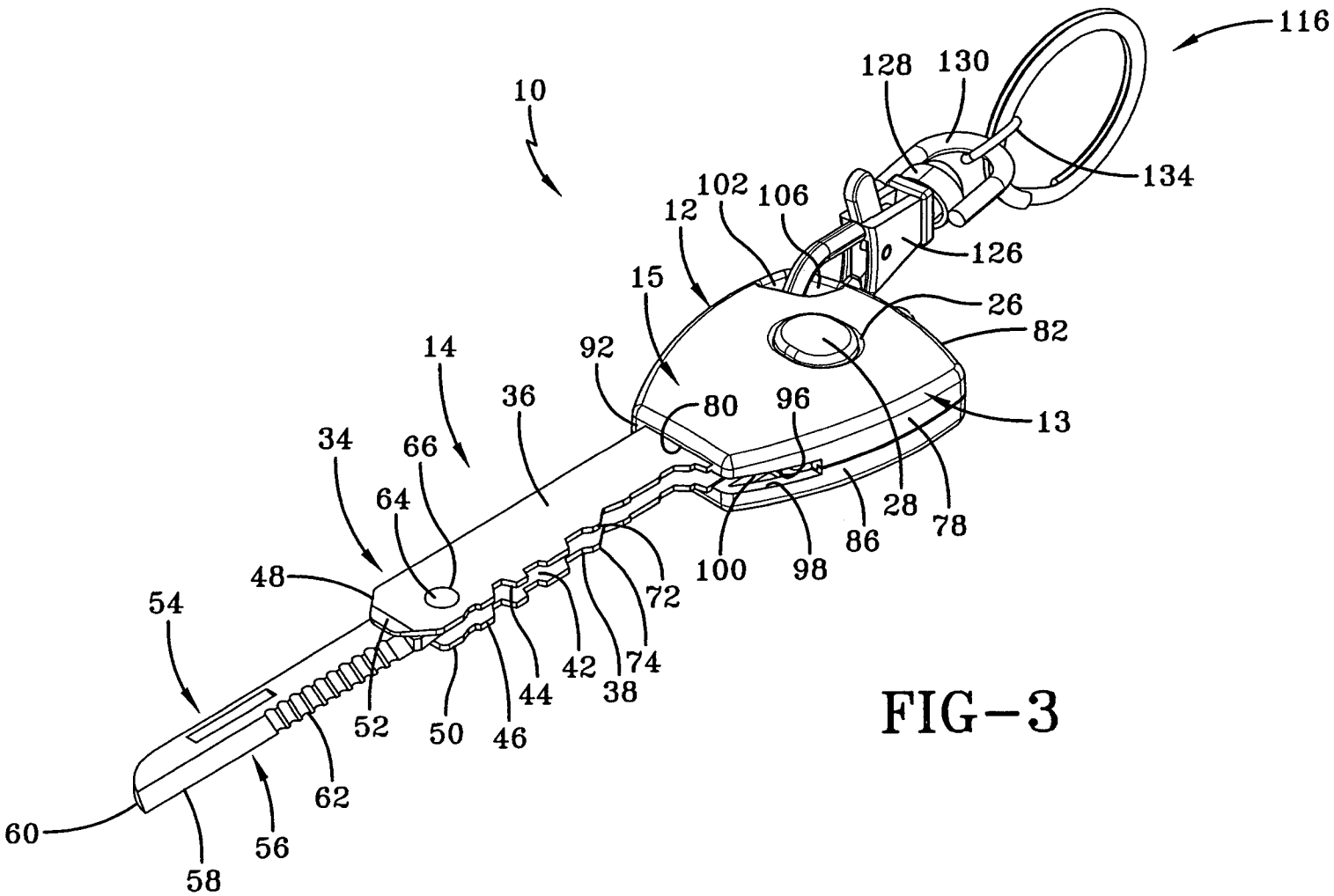
FIG. 3 is a perspective view of the device shown in FIGS. 1 and 2 with the knife blade in an open position.
Figure 4:
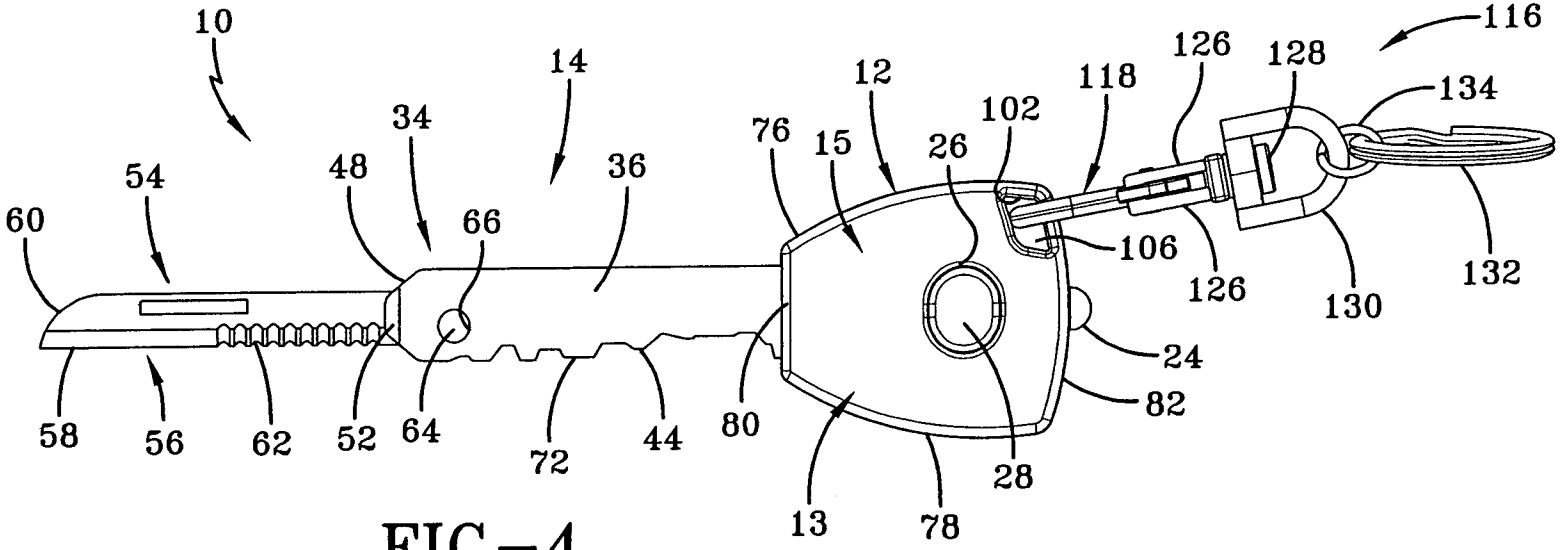
FIG. 4 is top view of the device shown in FIGS. 1-3, with the knife blade in the open position.
Figure 5:
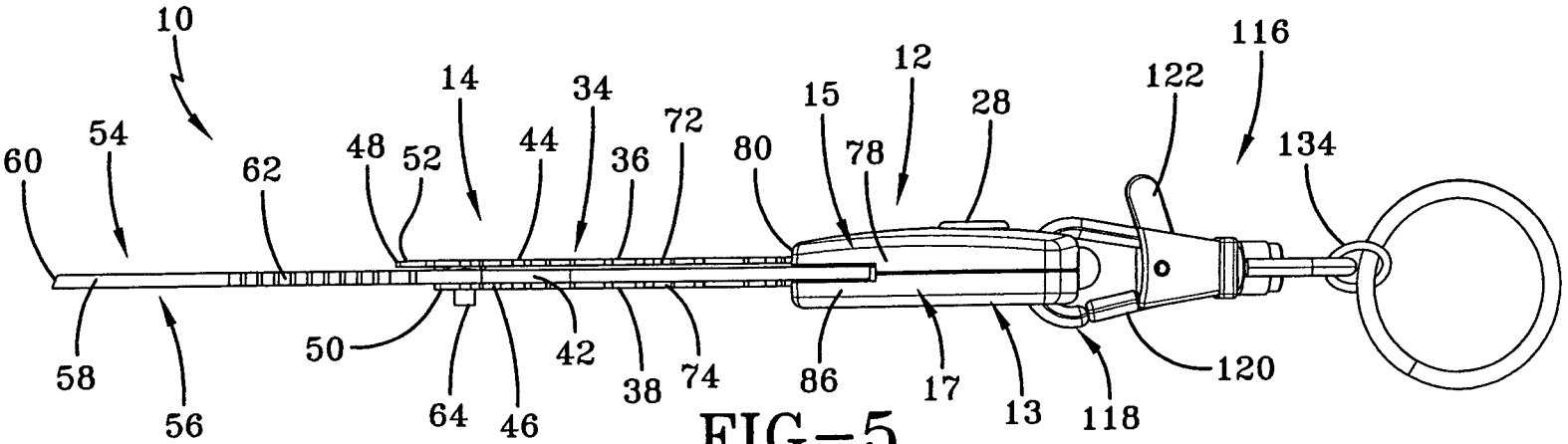
FIG. 5 is a side view of the device shown in FIG. 4.

Key blade end sides 80 and 88 of front key head housing 15 and rear key head housing 17, respectively, have respective shoulders 92 and 94 for holding faux key blade housing 34 in place insofar as it prevents movement of housing 34 beyond shoulders 92 and 94. However, front key head housing 15 and rear key head housing 17 have respective recess-defining walls 96 and 98, respectively, which oppose each other and cooperate to define a knife blade recess 100 for receiving knife blade 54 as it rotates to or from the closed position as shown in FIGS. 1 and 2, to or from open position shown in FIGS. 3-8. It is apparent from the description herein, including FIGS. 3-5, that one operates knife blade 54 by rotating it to its open position, manually grasping key head housing 13 since it functions as a handle, and moving device 10 and key blade 54 with its cutting edge portion 56 towards the object to be cut. The relatively long distance from head housing 13 to cutting portion 56 provides sufficient torque to perform the cutting operation. Actuating button opening 26 and actuating button 28 are located proximal free end side 82 of device 10, and do not overlap knife blade 54 and walls 36, 38 to maintain the thinness of head assembly 12 to assist in making device 10 have the appearance of a key.

Front head housing 15 has hole-defining surfaces 102, and rear key head housing 17 has hole-defining surfaces 104. Surfaces 102 and 104 together form a key ring-receiving orifice 106.

Turning to FIGS. 6-8, the interior of rear key head housing 17 is shown. A circuit board 108 is mounted in appropriately configured walls of a circuit board compartment 111 within key head assembly 12. Circuit board 108 is connected by a set of leads 110 and to a pair of batteries 112 and 114. Also included in the electrical circuit is actuating button 28 and the switch which operates to close the circuit between batteries 112 and 114 and the bulb in LED lens 24. Key head housing 13 has circuit board compartment 111, an actuating button compartment 113 and an LED-with-lens compartment 115. All of the components associated with LED lens 24 are displaced from walls 36, 38 and knife blade 54 in the closed position, and are located in key head housing 13 to help to make device 10 more key-like in appearance and render head assembly 12 as thin as keys used in automobiles and motor vehicles.

A quick-disconnect key ring assembly 116 is attached to faux key tool and illuminating device 10. Quick-disconnect key ring assembly 116 has an annular latch 118 with a jaw 120 which is fixed to a quick-release lever 122. Quick-release lever 122 and jaw 120 are pivotally mounted on a pivot pin 124 (FIG. 1) which extends between a pair of walls 126. Quick-disconnect key ring assembly 116 has a non-binding swivel 128 to which is attached a U-shaped member 130. Quick-disconnect key ring assembly 116 includes a key ring 132 which is attached to U-shaped member 130 by means of a relatively small ring 134. Key ring 132 is a split ring and can be used to accommodate various types of keys and other implements to be stored on a key ring.

In order to assembly quick-disconnect key ring assembly 116 onto faux key tool and illuminating device 10, one simply rotates quick-release lever 122 in the direction towards non-binding swivel 128 to open jaw 120, and annular latch 118 is slid through key ring-receiving orifice 106. The quick-release lever is released, and an appropriate spring biases jaw 120 to its closed position to close annular latch 118 to latch quick-disconnect key ring assembly 116 to tool and illuminating device 10. To remove quick-disconnect key ring assembly 116 from device 10, one simply moves quick-release lever 122 to open jaw 120 and open annular latch 118 is slid out of key ring-receiving orifice 106.

It should be apparent that the preferred embodiment of the invention described above accomplishes all of the objects of the invention. Faux key tool and illuminating device 10 is attractive in appearance and looks very much like a key. Knife blade 54 can easily be moved between the open and closed positions, and actuating button 28 can easily be depressed to illuminate LED lens 24. It is also apparent from the drawings such as in FIGS. 3-5 that one can operate device 10 by simply opening knife blade 54 and rotating it from the closed position to the open position and grasping key head housing 13 and moving device 10 in one direction towards the item to be cut to enable cutting edge portion 56 to do the cutting operation. The key head housing is preferably coated with a hard, moldable plastic such as polycarbonate/acrylonitrile butadiene styrene that does not undergo a chemical change when heated to both facilitate the manual operation of device 10 to make it look more like an automobile or motor vehicle key.

The invention has been described in detail with particular reference to the preferred embodiment, and variations and modifications within the spirit and scope of the invention may occur to those skilled in the art to which the invention pertains from the description set forth and from the appended claims.

We claim:

1. A faux key tool and illuminating device having a longitudinal direction and comprising:

a key head assembly having a lateral direction transverse to the longitudinal direction and including:

a key head housing comprising:

a set of housing walls defining relatively wide, generally flat key head housing exterior surfaces and a housing interior;

a battery compartment in said housing interior and being configured to hold at least one cell battery in a compact relationship, each of said at least one cell battery having opposing cell battery flat surfaces, said battery compartment holding said at least one battery with the opposing cell battery flat surface being parallel to said generally flat head housing exterior surfaces;

a lens opening for a lens for sending lumination in a lumination path;

an LED-with-lens compartment for holding an LED-with lens; and an actuating button opening for rendering an actuating button accessible; and a faux key blade housing comprising;

a pair of opposing, generally flat elongated walls extending longitudinally from said key head housing in the opposite direction of the longitudinal lumination path, in an opposing relationship, said elongated walls being spaced from each other defining a blade-receiving space therebetween, said elongated walls having a lateral dimension less than the lateral dimension of said housing walls to assist in making said device have the appearance of a motor vehicle key, said elongated walls each having opposing longitudinally extending edges with free ends distal from said head assembly and the opposing respective edges of one of said elongated walls opposing a respective edge of the other of said elongated walls to form two pairs of opposing edges, at least one of said pairs of opposing edges having faux key teeth; and a single knife blade pivot between said pair of opposing generally flat elongated walls proximal said distal free ends; and a knife blade mounted on said single pivot for pivotal movement between said pair of opposing generally flat elongated walls, said knife blade comprising a cutting edge exposed for a cutting operation when said knife blade is in the open position and unexposed for a cutting operation when said knife blade is in the closed position;

said battery compartment and said LED-with-lens compartment being longitudinally spaced and separated from said flat elongated walls and said knife blade when in the closed position to assist in rendering said key head assembly thin and to give the device the appearance of a motor vehicle key;

said key head housing functioning as a handle and being manually engageable to apply force to said knife blade when said knife is in the open position to obtain sufficient torque on said knife blade to enable said cutting edge to perform a cutting operation.

2. A faux key tool and illuminating device according to claim 1 wherein said key head assembly further comprises a circuit board compartment for holding a circuit board, and an actuating button compartment for holding an actuating button in a snug relationship, said circuit board compartment and said actuating button compartment being longitudinally spaced and separated from said elongated walls and from said knife blade in the closed position, and said faux key tool and illuminating device further comprising:

a circuit board in said circuit board compartment and being electrically connectable to at least one battery in said battery compartment;

an actuating button longitudinally spaced and separated from said elongated walls and knife blade in the closed position in said actuating button compartment for selectively connecting at least one battery in said battery compartment to said circuit board, said actuating button being accessible through said actuating button opening; and an LED with a lens operably connected to said circuit board and in alignment with said lens opening for sending illumination through said lens opening along the lumination path in response to actuation of said actuating button.

3. A faux key tool and light device according to claim 1 wherein said cutting edge portion of said knife blade includes a straight knife blade portion and a serrated knife blade portion.

4. A faux key tool and illuminating light device according to claim 2 wherein said key head housing includes a front key head housing and an opposing rear key head housing, a key blade end side having said opposing generally flat elongated walls extending therefrom and an opposing free light-emitting side, said lens opening being disposed on said light-emitting side.

5. A faux key tool and illuminating light device according to claim 4 wherein said actuating button opening is disposed in said front key head housing of said key head housing, and said battery compartment includes a selectively removable battery compartment cover located on said rear key head housing.

6. A faux key tool and light device according to claim 4 wherein said battery compartment comprises at least one single battery compartment for holding at least one battery and a selectively removable battery compartment cover having an open cover position and a closed position for selectively opening and closing said single battery compartment, said selectively removable battery compartment cover being disposed on said rear key head housing of said key head housing when said selectively removable battery compartment cover is in the closed cover position, said battery compartment cover being removable in a direction perpendicular to the longitudinal direction of said device.

7. A faux key tool and illuminating light device according to claim 1 wherein the free end of one of said pair of opposing generally flat elongated walls has a screwdriver head.

8. A faux key tool and illuminating light device according to claim 1 wherein said head housing includes a key ring-receiving orifice, and said faux key tool and light device further comprises:

a quick-disconnect key ring assembly, said quick-disconnect key ring assembly including:

an annular latch having a lever-operated jaw, said lever-operated jaw being manually openable to be received in said key ring-receiving orifice and being biased to a closed position; and a key ring operatively connected to said annular latch for receiving keys.

9. A faux key tool and illumination device according to claim 1 wherein said generally flat key head housing exterior surfaces are coated with a hard, moldable plastic.

* * * * *